US010550542B2

(12) United States Patent
Okada et al.

(10) Patent No.: US 10,550,542 B2
(45) Date of Patent: Feb. 4, 2020

(54) CONSTRUCTION MACHINE

(71) Applicant: SUMITOMO HEAVY INDUSTRIES, LTD., Tokyo (JP)

(72) Inventors: Junichi Okada, Kanagawa (JP); Takumi Itoh, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 241 days.

(21) Appl. No.: 15/633,916

(22) Filed: Jun. 27, 2017

(65) Prior Publication Data

US 2017/0292243 A1 Oct. 12, 2017

Related U.S. Application Data

(63) Continuation of application No. PCT/JP2015/086291, filed on Dec. 25, 2015.

(30) Foreign Application Priority Data

Jan. 6, 2015 (JP) ..... 2015-000780

(51) Int. Cl.
*E02F 3/43* (2006.01)
*F15B 11/028* (2006.01)
(Continued)

(52) U.S. Cl.
CPC ..... *E02F 3/435* (2013.01); *E02F 3/32* (2013.01); *E02F 9/2004* (2013.01);
(Continued)

(58) Field of Classification Search
CPC . E02F 3/435; E02F 9/2003; E02F 3/32; E02F 9/2004; E02F 9/2271; E02F 9/2221;
(Continued)

(56) References Cited

U.S. PATENT DOCUMENTS 5,305,681 A 4/1994 Devier et al.
5,481,875 A * 1/1996 Takamura ..... E02F 9/2235 60/443
(Continued)

FOREIGN PATENT DOCUMENTS

EP 2679735 1/2014
JP H05-106607 4/1993
(Continued)

OTHER PUBLICATIONS

International Search Report for PCT/JP2015/086291 dated Apr. 5, 2016.

*Primary Examiner* — Mary Cheung
(74) *Attorney, Agent, or Firm* — IPUSA, PLLC

(57) ABSTRACT

A construction machine includes a hydraulic cylinder configured to drive an attachment, a hydraulic circuit configured to supply hydraulic oil to the hydraulic cylinder, an input device that is operated by an operator, and a controller configured to control the hydraulic circuit in at least one of a first control mode where the attachment is caused to generate a force corresponding to an operation amount of the input device and a second control mode where the attachment is driven at a velocity corresponding to the operation amount of the input device.

9 Claims, 11 Drawing Sheets

(51) Int. Cl.

| | |
|---|---|
| ***F15B 11/04*** | (2006.01) |
| ***E02F 3/32*** | (2006.01) |
| ***E02F 9/20*** | (2006.01) |
| ***E02F 9/22*** | (2006.01) |

(52) U.S. Cl.
CPC ..... *E02F 9/2203* (2013.01); *E02F 9/2221* (2013.01); *E02F 9/2271* (2013.01); *F15B 11/028* (2013.01); *F15B 11/04* (2013.01); *F15B 2211/6309* (2013.01); *F15B 2211/6313* (2013.01); *F15B 2211/6326* (2013.01); *F15B 2211/6346* (2013.01)

(58) Field of Classification Search
CPC . F15B 11/04; F15B 11/028; F15B 2211/6326; F15B 2211/6346; F15B 2211/6309; F15B 2211/6313
See application file for complete search history.

(56) References Cited

U.S. PATENT DOCUMENTS

| | | | | |
|---|---|---|---|---|
| 5,946,910 | A * | 9/1999 | Hayashi | E02F 9/2225 60/421 |
| 5,953,977 | A | 9/1999 | Krishna et al. | |
| 6,108,948 | A * | 8/2000 | Tozawa | E02F 3/435 172/2 |
| 6,286,412 | B1 | 9/2001 | Manring et al. | |
| 2001/0027366 | A1* | 10/2001 | Ikari | E02F 3/432 701/50 |
| 2004/0118623 | A1* | 6/2004 | Shore | B60K 6/12 180/165 |
| 2007/0216331 | A1* | 9/2007 | Morinaga | E02F 9/123 318/561 |
| 2008/0104953 | A1* | 5/2008 | Vigholm | E02F 9/2217 60/413 |
| 2011/0168283 | A1* | 7/2011 | Sakamoto | E02F 9/2004 137/565.29 |
| 2012/0304634 | A1* | 12/2012 | Ooi | E02F 9/2246 60/423 |
| 2013/0332036 | A1 | 12/2013 | Yamamoto et al. | |
| 2014/0105714 | A1 | 4/2014 | Kim | |
| 2014/0200795 | A1* | 7/2014 | Kawaguchi | F02D 31/008 701/110 |
| 2015/0300270 | A1* | 10/2015 | Murakami | F02D 29/04 701/22 |
| 2016/0040391 | A1* | 2/2016 | Imaizumi | E02F 9/2203 701/50 |
| 2016/0298313 | A1* | 10/2016 | Amano | E02F 9/123 |

FOREIGN PATENT DOCUMENTS

| | | |
|---|---|---|
| JP | H06-330902 | 11/1994 |
| JP | H07-189297 | 7/1995 |
| JP | 2001-193707 | 7/2001 |
| JP | 2010-084784 | 4/2010 |
| JP | 2012-127154 | 7/2012 |
| JP | 2013-121244 | 6/2013 |
| JP | 2013-249938 | 12/2013 |
| JP | 2014-513226 | 5/2014 |

* cited by examiner $$TM = (P1 \times A1) - (P2 \times A2)$$

$$VM = Q1/A1 = -Q2/A2$$

CONSTRUCTION MACHINE

RELATED APPLICATIONS

The present application is a continuation application filed under 35 U.S.C. 111(a) claiming benefit under 35 U.S.C. 120 and 365(c) of PCT International Application No. PCT/JP2015/086291, filed on Dec. 25, 2015, which is based on and claims the benefit of priority of Japanese Patent Application No. 2015-000780 filed on Jan. 6, 2015, the entire contents of which are incorporated herein by reference.

BACKGROUND

Technical Field

An aspect of this disclosure relates to a construction machine.

Description of Related Art

A related-art method of driving a boom, an arm, and a bucket of a typical shovel is described below.

When a lever input for driving the bucket is entered, the opening area of a valve of a hydraulic cylinder for the bucket increases. When the opening area of the valve increases, hydraulic oil flows into the hydraulic cylinder and the hydraulic cylinder moves. Then, the bucket is driven by the movement of the hydraulic cylinder. The arm and the boom are driven in a similar manner in response to lever inputs. As the lever input increases, the opening area of the valve increases and the rate of flow of the hydraulic oil into the hydraulic cylinder increases. As a result, the velocity and the thrust of the hydraulic cylinder change.

There exists a known work machine where a structure such as a boom is driven by a hydraulic motor and an electric motor that operates in coordination with the hydraulic motor. The hydraulic motor is driven by hydraulic oil supplied via a control valve from a hydraulic pump.

In the work machine, in response to a velocity command that is based on the operation amount of a remote-control valve for determining the operation amount of the structure, a velocity feedback control is performed based on the actual rotational velocity of the hydraulic motor and a differential-pressure feedback control is performed based on the difference between hydraulic oil pressures at an inlet port and an outlet port of the hydraulic motor. These feedback controls make it possible to control the opening of the control valve to output an amount of hydraulic oil necessary at the actual rotational velocity of the hydraulic motor. This in turn makes it possible to reduce the amount of energy that is lost when hydraulic oil is relieved from a relief valve.

The discharge rate of the hydraulic pump corresponds to the moving velocity of the hydraulic cylinder. As the discharge rate of the hydraulic pump increases, the moving velocity of the hydraulic cylinder increases. When performing an operation such as a positioning operation where no reaction force is applied to a working part such as the bucket, it is preferable that the moving velocity of the hydraulic cylinder changes according to the operation amount of an operation lever.

In contrast, in work such as excavation or leveling, a large reaction force is applied by the ground to the bucket (point of application). When the reaction force is so large that the relief valve opens, the moving velocity of the hydraulic cylinder does not increase even when the discharge rate of the hydraulic pump is increased. Accordingly, in this case, it is not possible to achieve the moving velocity of the hydraulic cylinder corresponding to the operation amount of the operation lever. In such a case, it is preferable that the thrust generated by the hydraulic cylinder changes according to the operation amount of the operation lever.

With the related-art method where the opening of the control valve of the hydraulic cylinder is changed according to the operation amount of the operation lever, the moving velocity and the thrust corresponding to the operation amount cannot always be achieved. This reduces the work efficiency. An operator needs to have skill in order to achieve desired moving velocity and thrust.

SUMMARY

In an aspect of this disclosure, there is provided a construction machine including a hydraulic cylinder configured to drive an attachment, a hydraulic circuit configured to supply hydraulic oil to the hydraulic cylinder, an input device that is operated by an operator, and a controller configured to control the hydraulic circuit in at least one of a first control mode where the attachment is caused to generate a force corresponding to an operation amount of the input device and a second control mode where the attachment is driven at a velocity corresponding to the operation amount of the input device.

DETAILED DESCRIPTION

A construction machine according to an embodiment is described below with reference to FIGS. 1 through 4.

Figure 1:
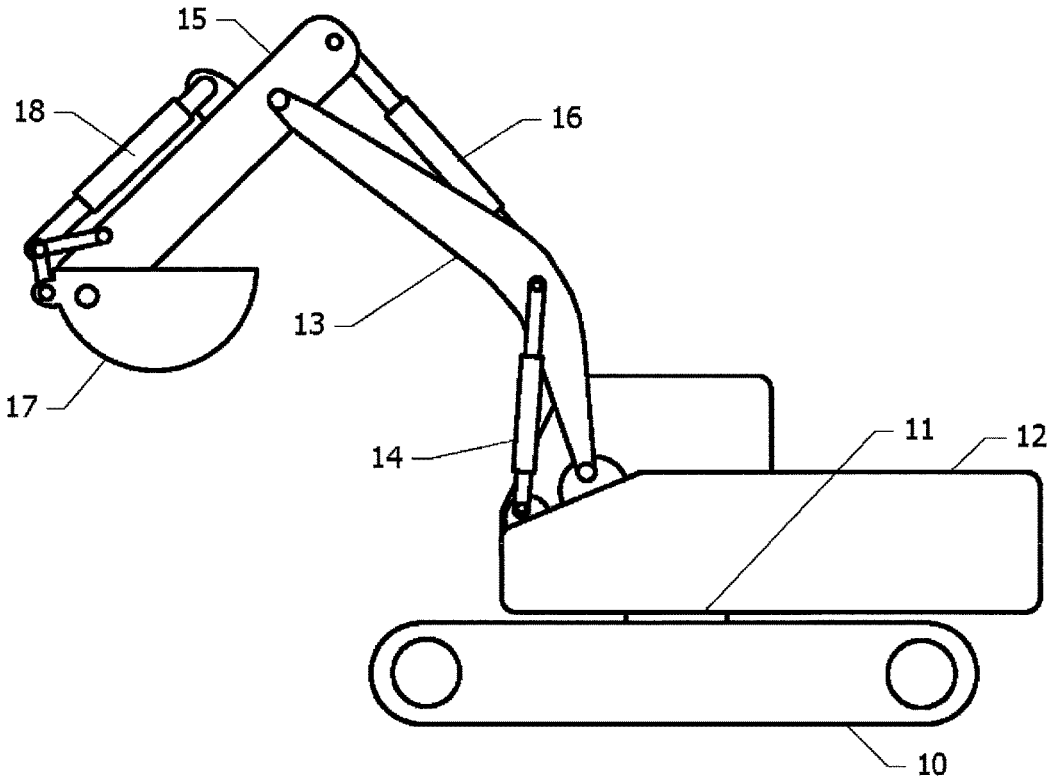
FIG. 1 is a side view of a construction machine according to an embodiment.

FIG. 1 is a side view of the construction machine according to the embodiment. The construction machine includes a lower traveling body 10 on which an upper rotating body 12 is mounted via a rotating mechanism 11. Working parts including a boom 13, an arm 15, and a bucket 17 are attached to the upper rotating body 12. The working parts are hydraulically driven by hydraulic cylinders including a boom cylinder 14, an arm cylinder 16, and a bucket cylinder 18. The boom 13, the arm 15, and the bucket 17 constitute an excavating attachment. Attachments that can be attached to the construction machine include, in addition to the excavating attachment, a crushing attachment and a lifting magnet attachment.

Figure 2:
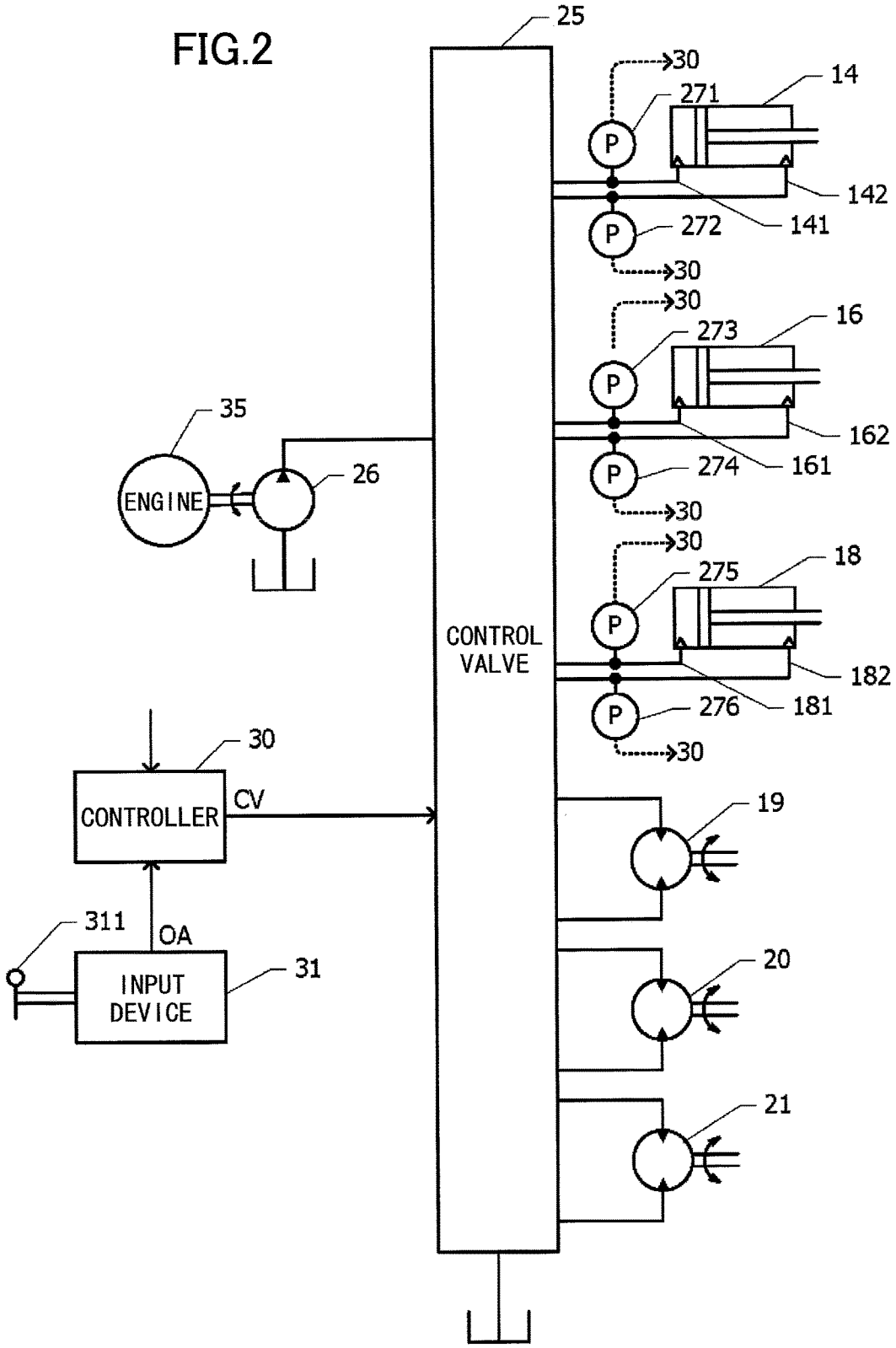
FIG. 2 is a schematic diagram of a hydraulic circuit and a hydraulic control system of a construction machine according to an embodiment.

Next, a hydraulic circuit and a hydraulic control system of the construction machine of the present embodiment are described with reference to FIG. 2. FIG. 2 is a schematic diagram of the hydraulic circuit and the hydraulic control system of the construction machine of the present embodiment. The hydraulic circuit supplies hydraulic oil to the hydraulic cylinders including the boom cylinder 14, the arm cylinder 16, and the bucket cylinder 18. Also, the hydraulic circuit supplies hydraulic oil to hydraulic motors 19, 20, and 21. The hydraulic motors 19 and 20 drive two crawlers of the lower traveling body 10 (FIG. 1). The hydraulic motor 21 rotates the upper rotating body 12 (FIG. 1).

The hydraulic circuit includes a hydraulic pump 26 and control valves 25. The hydraulic pump 26 is driven by an engine 35. The engine 35 may be implemented by, for example, an internal combustion engine such as a diesel engine. The hydraulic pump 26 supplies high-pressure hydraulic oil to the control valves 25. The control valves 25 include directional control valves and flow control valves. The directional control valves and the flow control valves are provided for respective actuators.

A bottom chamber and a rod chamber of the boom cylinder 14 are connected to the control valves 25 via a hydraulic line 141 and a hydraulic line 142, respectively. A bottom chamber and a rod chamber of the arm cylinder 16 are connected to the control valves 25 via a hydraulic line 161 and a hydraulic line 162, respectively. A bottom chamber and a rod chamber of the bucket cylinder 18 are connected to the control valves 25 via a hydraulic line 181 and a hydraulic line 182, respectively.

Pressure sensors 271 and 272 measure the pressures of hydraulic oil supplied to the bottom chamber and the rod chamber of the boom cylinder 14 or the pressures of hydraulic oil discharged from the bottom chamber and the rod chamber. Pressure sensors 273 and 274 measure the pressures of hydraulic oil supplied to the bottom chamber and the rod chamber of the arm cylinder 16 or the pressures of hydraulic oil discharged from the bottom chamber and the rod chamber. Pressure sensors 275 and 276 measure the pressures of hydraulic oil supplied to the bottom chamber and the rod chamber of the bucket cylinder 18 or the pressures of hydraulic oil discharged from the bottom chamber and the rod chamber. Measurements obtained by the pressure sensors 271 through 276 are input to a controller 30.

An input device 31 includes operation levers 311 that are operated by an operator. The input device 31 generates pilot pressures or electric signals corresponding to operation amounts OA of the operation levers 311. The pilot pressures or the electric signals corresponding to the operation amounts OA are input to the controller 30.

The controller 30 generates, based on the operation amounts OA input from the input device 31, control values CV for driving the hydraulic cylinders including the boom cylinder 14, the arm cylinder 16, and the bucket cylinder 18. The pilot pressures or the electric signals corresponding to the control values CV are applied to the control valves 25. The controller 30 may be configured to apply pilot pressures to some control valves 25 and apply electric signals to the other control valves 25. For example, hydraulic valves may be used for directional control valves, and solenoid valves may be used for flow control valves. The controller 30 also generates, based on operation amounts OA, control values CV for driving the hydraulic motors 19 through 21. The hydraulic cylinders and the hydraulic motors 19 through 21 are driven by controlling the control valves 25 based on the control values CV.

Next, a hydraulic control method performed by the construction machine of the present embodiment is described with reference to FIGS. 3 and 4.

Figure 3:
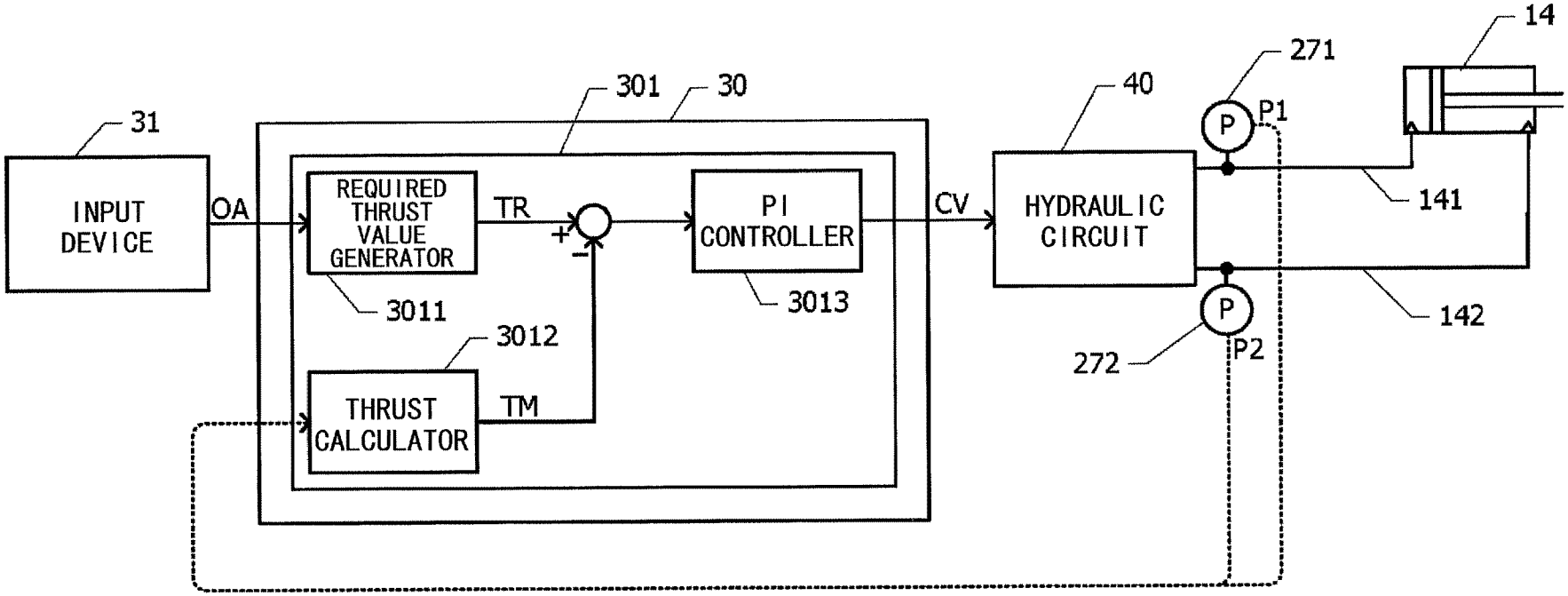
FIG. 3 is a block diagram illustrating a controller, a hydraulic circuit, and a hydraulic cylinder.
Figure 4:
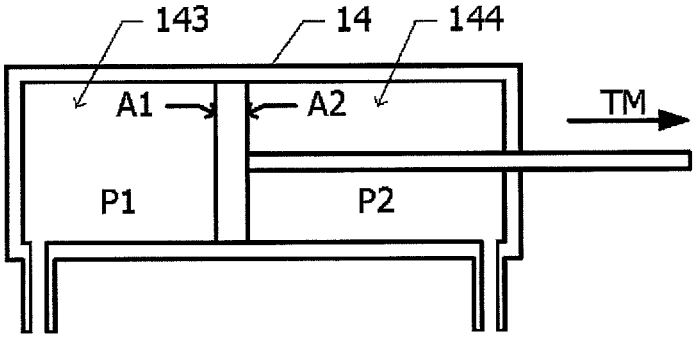
FIG. 4 is a schematic diagram of a boom cylinder.

FIG. 3 is a block diagram illustrating the controller 30, a hydraulic circuit 40, and a hydraulic cylinder. In FIG. 3, the boom cylinder 14 is illustrated as the hydraulic cylinder. The hydraulic circuit 40 includes the hydraulic pump 26 and the control valves 25 (FIG. 2). The hydraulic circuit 40 is connected via the hydraulic line 141 to the bottom chamber of the boom cylinder 14, and is connected via the hydraulic line 142 to the rod chamber of the boom cylinder 14. The arm cylinder 16 and the bucket cylinder 18 (FIGS. 1 and 2) are also controlled similarly to the boom cylinder 14.

The controller 30 includes a thrust controller 301. The thrust controller 301 includes a required thrust value generator 3011, a thrust calculator 3012, and a PI controller 3013. The input device 31 inputs an operation amount OA to the required thrust value generator 3011. Based on the input operation amount OA, the required thrust value generator 3011 generates a required thrust value TR. For example, the required thrust value TR is proportional to the operation amount OA.

Pressure measurements P1 and P2 measured by the pressure sensors 271 and 272 are input to the thrust calculator 3012. The pressure sensor 271 measures the pressure of hydraulic oil in the bottom chamber of the boom cylinder 14. The pressure sensor 272 measures the pressure of hydraulic oil in the rod chamber of the boom cylinder 14.

Based on the pressure measurements P1 and P2 of hydraulic oil in the bottom chamber and the rod chamber of the boom cylinder 14, the thrust calculator 3012 calculates thrust of the boom cylinder 14, and outputs the calculated thrust as a thrust measurement TM.

A method of calculating the thrust measurement TM is described with reference to FIG. 4. The thrust measurement TM may be calculated using the following formula where A1 indicates the cross-sectional area of a bottom chamber 143 of the boom cylinder 14, A2 indicates the cross-sectional area of a rod chamber 144 of the boom cylinder 14, P1 indicates the pressure measurement of hydraulic oil in the bottom chamber 143, and P2 indicates the pressure measurement of hydraulic oil in the rod chamber 144.

$$TM=(P1\times A1)-(P2\times A2)$$

The PI controller 3013 in FIG. 3 outputs a control value CV to the hydraulic circuit 40 such that the difference (thrust difference) between the required thrust value TR and the thrust measurement TM is minimized. For example, the control value CV corresponds to the opening area of a flow control valve of the hydraulic circuit 40.

The hydraulic circuit 40 is feedback-controlled such that the thrust difference between the required thrust value TR and the thrust measurement TM is minimized, and therefore the thrust of the boom cylinder becomes close to the required thrust value TR corresponding to the operation amount OA input by the operator. This configuration makes it possible to generate thrust required by the operator, and thereby makes it possible to improve the efficiency of work such as excavation where a force generated at the point of application of a working part needs to be adjusted.

Next, a construction machine according to another embodiment is described with reference to FIG. 5. Below, differences between the embodiment of FIG. 5 and the embodiment of FIGS. 1 through 4 are mainly described, and descriptions of configurations common to both of the embodiments are omitted.

Figure 5:
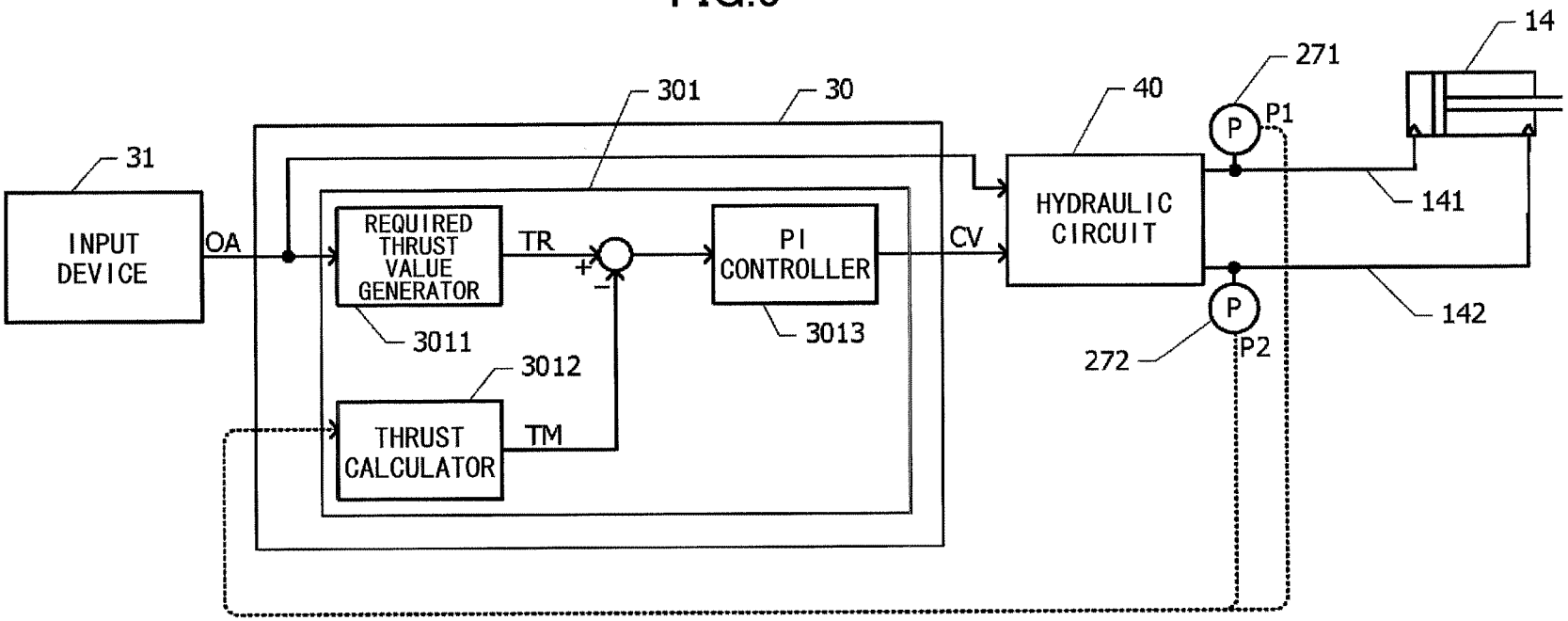
FIG. 5 is a block diagram illustrating a controller, a hydraulic circuit, and a hydraulic cylinder of a construction machine according to another embodiment.

FIG. 5 is a block diagram illustrating the controller 30, the hydraulic circuit 40, and a hydraulic cylinder. In the embodiment of FIG. 3, a pilot pressure or an electric signal indicating the operation amount OA is input to the controller 30. In the embodiment of FIG. 5, a pilot pressure indicating the operation amount OA is input to the controller 30.

A control valve of the hydraulic circuit 40 is driven by a pilot pressure indicating a control value CV. Another control valve of the hydraulic circuit 40 is driven by the pilot pressure indicating the operation amount OA. For example, a directional control valve is driven by the pilot pressure indicting the operation amount OA, and a flow control valve is driven by the pilot pressure indicating the control value CV.

Also in the embodiment of FIG. 5, the hydraulic circuit 40 is controlled such that the thrust difference between the required thrust value TR and the thrust measurement TM is minimized. Accordingly, similarly to the embodiment of FIGS. 1 through 4, the embodiment of FIG. 5 can make the thrust of the boom cylinder 14 close to the required thrust value TR corresponding to the operation amount OA input by the operator.

Next, a construction machine according to still another embodiment is described with reference to FIG. 6. Below, differences between the embodiment of FIG. 6 and the embodiment of FIGS. 1 through 4 are mainly described, and descriptions of configurations common to both of the embodiments are omitted.

Figure 6:
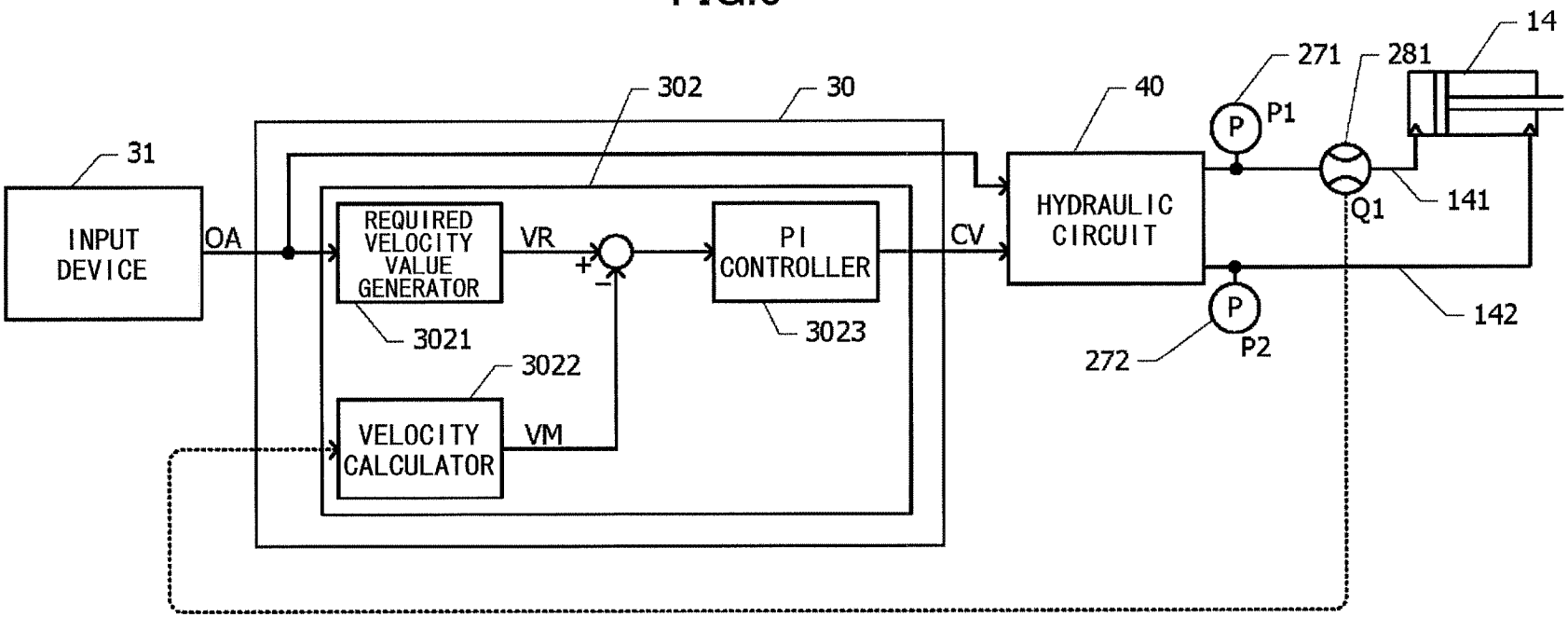
FIG. 6 is a block diagram illustrating a controller, a hydraulic circuit, and a hydraulic cylinder of a construction machine according to still another embodiment.

FIG. 6 is a block diagram illustrating the controller 30, the hydraulic circuit 40, and a hydraulic cylinder of the construction machine of this embodiment. In FIG. 5, the boom cylinder 14 is illustrated as the hydraulic cylinder. The arm cylinder 16 and the bucket cylinder 18 (FIGS. 1 and 2) are also controlled similarly to the boom cylinder 14.

In this embodiment, the controller 30 includes a velocity controller 302 instead of the thrust controller 301 in the embodiment of FIG. 3. A flow rate sensor 281 is provided in the hydraulic line 141. The flow rate sensor 281 measures the flow rate of hydraulic oil supplied to or discharged from the bottom chamber of the boom cylinder 14, and inputs the measured flow rate as a flow rate measurement Q1 to the controller 30.

The velocity controller 302 includes a required velocity value generator 3021, a velocity calculator 3022, and a PI controller 3023. The operation amount OA generated at the input device 31 is input to the required velocity value generator 3021. Based on the operation amount OA, the required velocity value generator 3021 generates a required velocity value VR. For example, the required velocity value VR is proportional to the operation amount OA.

The flow rate measurement Q1 measured by the flow rate sensor 281 is input to the velocity calculator 3022. Based on the flow rate measurement Q1, the velocity calculator 3022 calculates the moving velocity of the boom cylinder 14, and outputs the calculated moving velocity as a velocity measurement VM.

Figure 7:
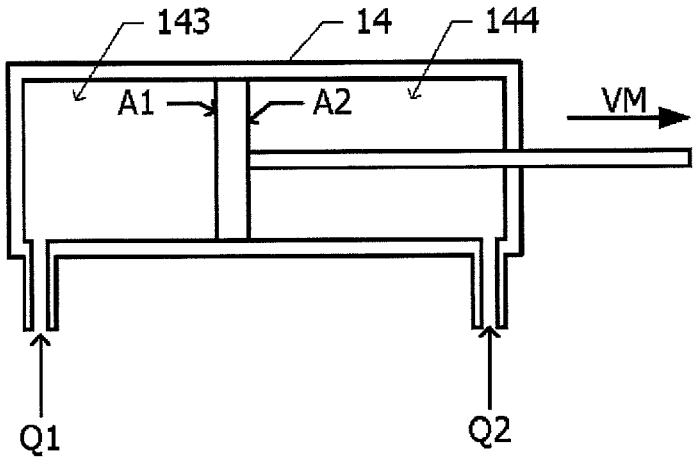
FIG. 7 is a schematic diagram of a boom cylinder.

A method of calculating the velocity measurement VM is described with reference to FIG. 7. The velocity measurement VM may be calculated using the following formula. In the formula, A1 indicates the cross-sectional area of the bottom chamber 143 of the boom cylinder 14, A2 indicates the cross-sectional area of the rod chamber 144 of the boom cylinder 14, Q1 indicates the flow rate of hydraulic oil flowing into the bottom chamber 143, Q2 indicates the flow rate of hydraulic oil flowing into the rod chamber 144, and the moving velocity in the direction in which the boom cylinder 14 expands is defined as a positive moving velocity.

$$VM=Q1/A1=-Q2/A2$$

Thus, the velocity measurement VM can be calculated by obtaining one of the flow rate measurement Q1 of hydraulic oil flowing into the bottom chamber 143 and the flow rate measurement Q2 of hydraulic oil flowing into the rod chamber 144. In the embodiment of FIG. 6, the flow rate sensor 281 measures the flow rate of hydraulic oil flowing into the bottom chamber 143, and outputs the measured flow rate as the flow rate measurement Q1.

The PI controller 3023 (FIG. 6) outputs a control value CV to the hydraulic circuit 40 such that the difference (velocity difference) between the required velocity value VR and the velocity measurement VM is minimized. That is, the hydraulic circuit 40 is feedback-controlled so that the velocity difference between the required velocity value VR and the velocity measurement VM is minimized. The control value CV output from the velocity controller 302 has the same dimension as the control value CV output from the thrust controller 301, and corresponds, for example, to the opening area of a flow control valve of the hydraulic circuit 40. With this configuration, the flow rate of hydraulic oil flowing into the boom cylinder 14 is controlled so that the moving velocity of the boom cylinder 14 matches the control value CV. The operator can drive a working part at a desired velocity by changing the operation amount OA.

Next, a construction machine according to still another embodiment is described with reference to FIGS. 8 and 9. Below, differences between the embodiment of FIGS. 8 and 9 and the embodiments of FIGS. 1 through 4 and FIGS. 6 and 7 are mainly described, and descriptions of configurations common to the embodiments are omitted. In this embodiment, control modes of hydraulic cylinders are switched between a thrust control mode and a velocity control mode.

Figure 8:
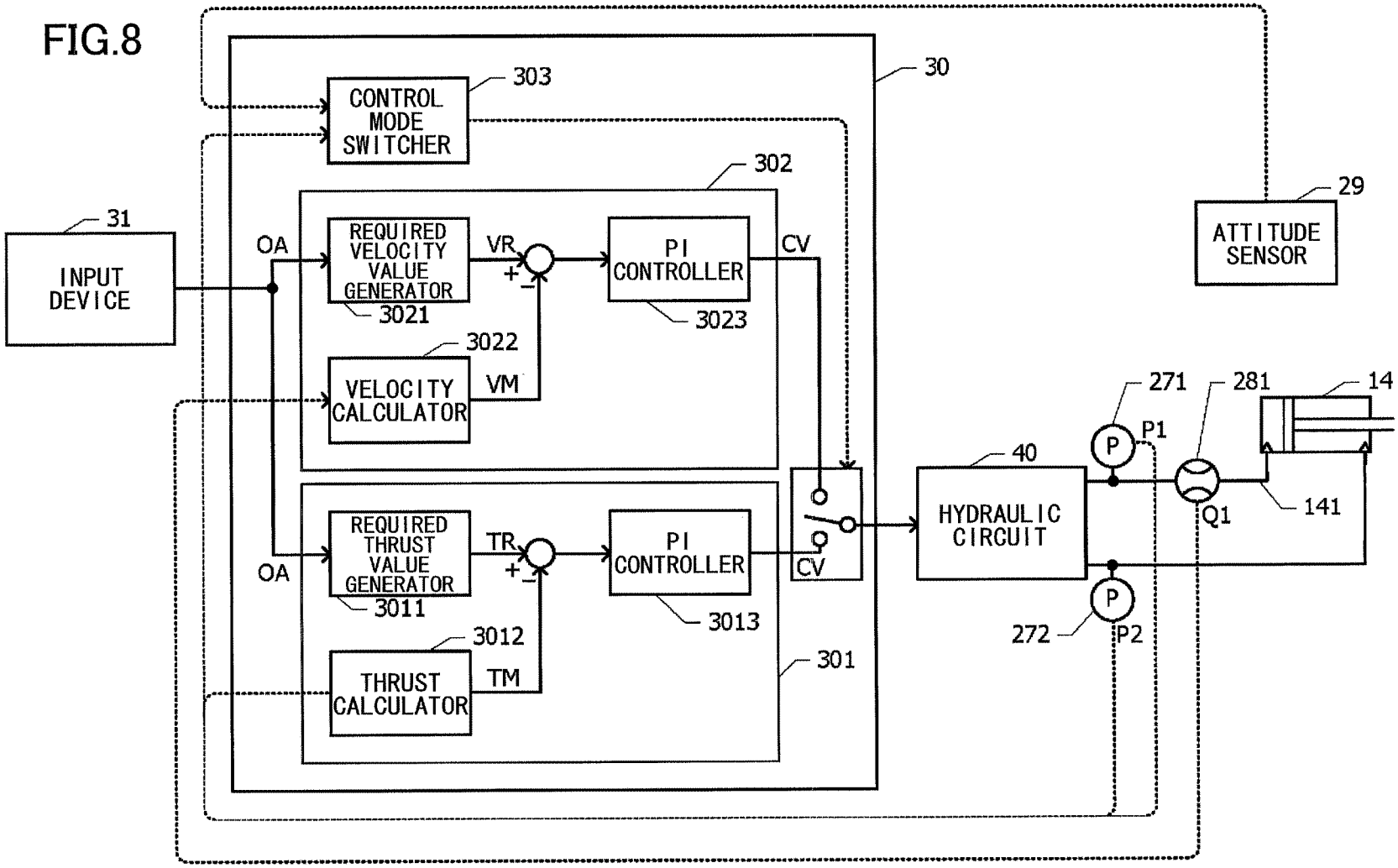
FIG. 8 is a block diagram illustrating a controller, a hydraulic circuit, and a hydraulic cylinder of a construction machine according to still another embodiment.

FIG. 8 is a block diagram illustrating the controller 30, the hydraulic circuit 40, and a hydraulic cylinder. In FIG. 8, the boom cylinder 14 is illustrated as the hydraulic cylinder. The arm cylinder 16 and the bucket cylinder 18 (FIGS. 1 and 2) are also controlled similarly to the boom cylinder 14.

An attitude sensor 29 detects the attitudes of working parts of the construction machine. The attitudes detected by the attitude sensor 29 are input to the controller 30.

The attitude sensor 29 (FIG. 8) is described with reference to FIG. 9. The attitude sensor 29 includes three angle sensors 291, 292, and 293. The angle sensor 291 measures an elevation angle θ1 of the boom 13. The angle sensor 292 measures an angle θ2 between the boom 13 and the arm 15. The angle sensor 293 measures an angle θ3 between the arm 15 and the bucket 17. Based on the elevation angle θ1, the angle θ2, and the angle θ3, it is possible to identify the attitudes of the working parts including the boom 13, the arm 15, and the bucket 17.

Instead of the angle sensors 291, 292, and 293, sensors for measuring the amounts of expansion of the boom cylinder 14, the arm cylinder 16, and the bucket cylinder 18 (FIGS. 1 and 2) may be provided. In this case, the elevation angle θ1, the angle θ2, and the angle θ3 can be determined based on the measured amounts of expansion of the cylinders.

The controller 30 in FIG. 8 includes the thrust controller 301, the velocity controller 302, and a control mode switcher 303. The controller 30 controls the hydraulic cylinders in one of the thrust control mode and the velocity control mode. The thrust controller 301 controls hydraulic cylinders including the boom cylinder 14 in the thrust control mode as described with reference to FIG. 3. The velocity controller 302 controls hydraulic cylinders including the boom cylinder 14 in the velocity control mode as described with reference to FIG. 6. The control mode switcher 303 switches between the thrust control mode and the velocity control mode.

Next, a process performed by the control mode switcher 303 is described. The control mode switcher 303 obtains a reaction force being applied to the point of application of the working parts based on the attitudes of the working parts detected by the attitude sensor 29 and the thrust of each of the boom cylinder 14, the arm cylinder 16, and the bucket cylinder 18. The point of application corresponds, for example, to the tip of the bucket 17 (FIG. 1). When detecting that the reaction force being applied to the point of application of the working parts exceeds a decision threshold, the control mode switcher 303 switches from the velocity control mode to the thrust control mode. When the reaction force becomes less than the decision threshold, the control mode switcher 303 switches from the thrust control mode back to the velocity control mode.

Next, a method of calculating a reaction force applied to the point of application is described with reference to FIG. 9. Gravity, Coriolis force, and the thrust of the boom cylinder 14, the arm cylinder 16, and the bucket cylinder 18 are applied to the boom 13, the arm 15, and the bucket 17. Also, a reaction force FC from the ground is applied to a point of application AP at the tip of the bucket 17. The reaction force FC can be obtained by solving an equation of motion using the forces applied to the boom 13, the arm 15, and the bucket 17, moments of inertia J1, J2, and J3 of the boom 13, the arm 15, and the bucket 17, the elevation angle θ1, the angle θ2, and the angle θ3.

Figure 9:
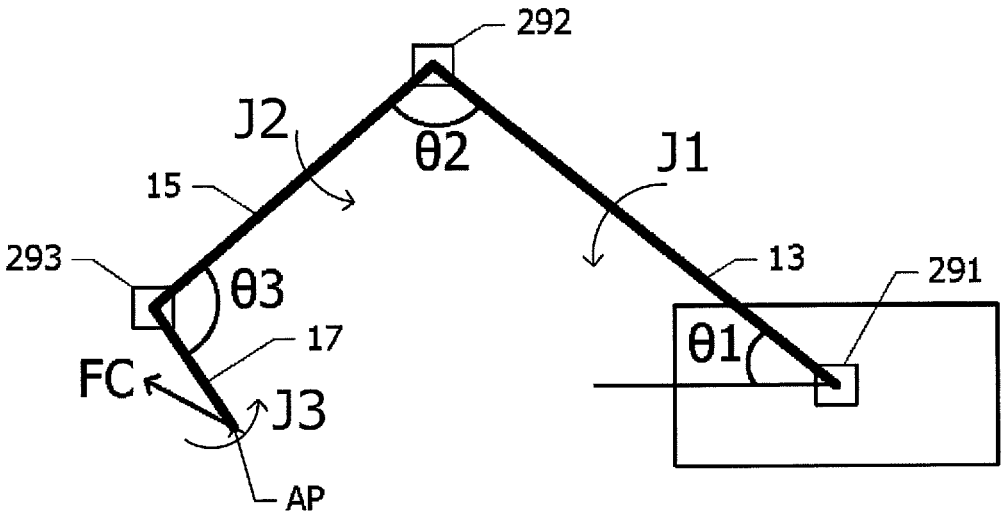
FIG. 9 is drawing illustrating attitudes of a boom, an arm, and a bucket, and an attitude sensor.

In the embodiment of FIGS. 8 and 9, the hydraulic cylinder is controlled based on the velocity of the hydraulic cylinder while the reaction force FC being applied to the point of application AP is less than the decision threshold. That is, the hydraulic cylinder is expanded and contracted at a moving velocity corresponding to the operation amount OA of the input device 31 (FIG. 8). For example, this makes it easier to perform a positioning operation of a working part. When the reaction force FC being applied to the point of application AP exceeds the decision threshold, the hydraulic cylinder is controlled based on thrust. Controlling the hydraulic cylinder in the thrust control mode makes it possible to improve the efficiency of work such as excavation that requires a large force.

The above configuration makes it possible to operate the hydraulic cylinder at a desired velocity or thrust corresponding to the operation amount OA, and thereby makes it possible to prevent reduction in the work efficiency even when a low-skilled operator performs work.

Next, a construction machine according to still another embodiment is described with reference to FIGS. 10A through 10C and FIG. 11. Below, differences between the embodiment of FIGS. 10A through 10C and FIG. 11 and the embodiment of FIGS. 8 and 9 are mainly described, and descriptions of configurations common to both of the embodiments are omitted. In the embodiment of FIGS. 8 and 9, the thrust control mode and the velocity control mode are switched based on the value of the reaction force FC applied to the point of application AP (FIG. 9) at the tip of the bucket 17. In this embodiment, the thrust control mode and the velocity control mode are switched based on other physical quantities.

Figure 10A:
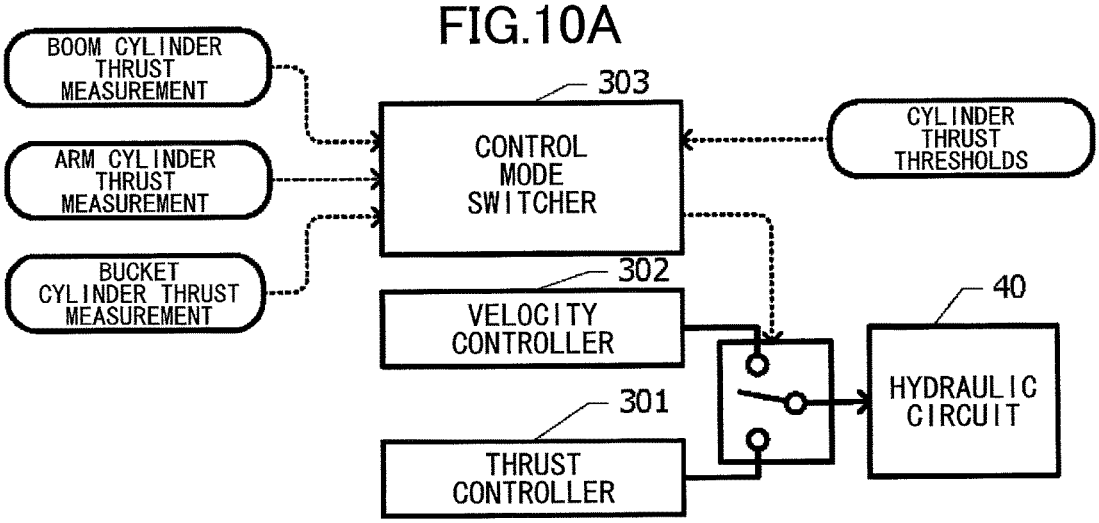
FIGS. 10A through 10C are block diagrams illustrating functional components related to a control mode switching process performed by a construction machine according to still another embodiment, and data to be referred to by the functional components.
Figure 10B:
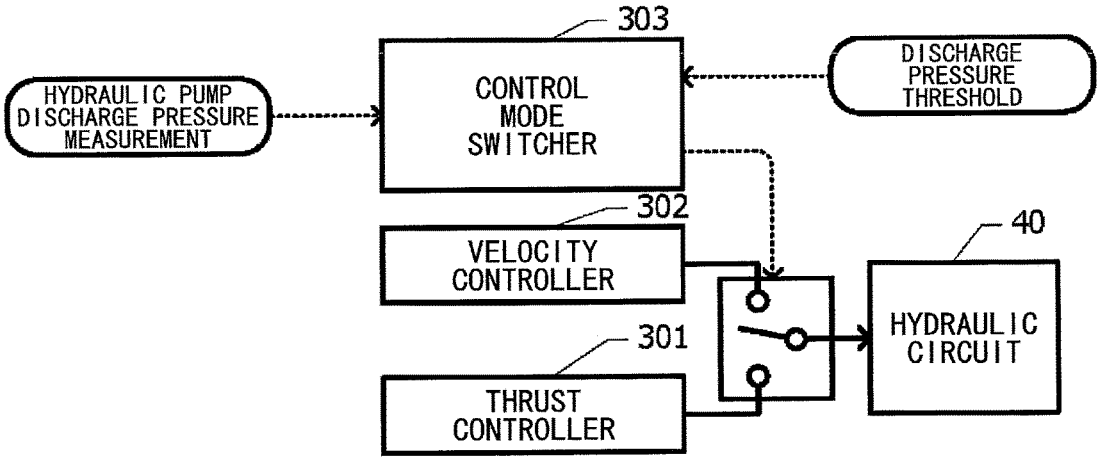
Figure 10C:
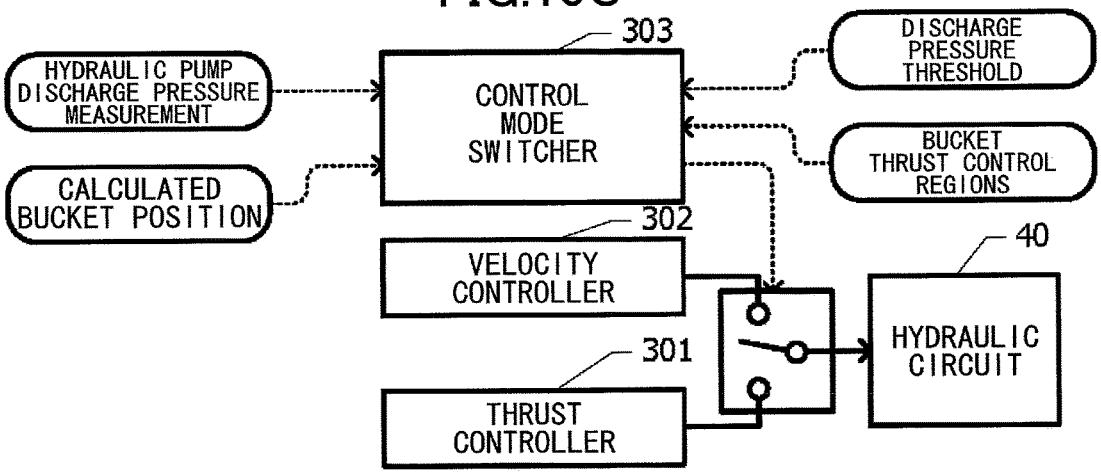

FIGS. 10A through 10C are block diagrams illustrating functional components related to a control mode switching process, and data to be referred to by the functional components.

In the example of FIG. 10A, control modes are switched based on the results of comparing a boom cylinder thrust measurement, an arm cylinder thrust measurement, and a bucket cylinder thrust measurement with the corresponding cylinder thrust thresholds. For example, when at least one of the cylinder thrust measurements is greater than the corresponding cylinder thrust threshold, the control mode switcher 303 switches from the velocity control mode to the thrust control mode. As illustrated by FIG. 4, the thrust measurement TM of each of the cylinders can be calculated based on the pressure measurement P1 of hydraulic oil in the bottom chamber, the pressure measurement P2 of hydraulic oil in the rod chamber, the cross-sectional area A1 of the bottom chamber, and the cross-sectional area A2 of the rod chamber. In other words, the thrust measurements TM of the cylinders can be calculated based on the measurements of the pressure sensors 271 through 276.

In excavation work, when the tip of the bucket is brought into contact with an excavation object (e.g., the ground) and a load is applied to the excavation object (during an excavation operation), the cylinder thrust measurements increase. The cylinder thrust thresholds used to determine whether a shovel is in the excavation operation can be determined for the respective cylinders by actually performing excavation work including a series of operations such as excavating, lifting, rotating, and dumping and by recording the temporal changes in the thrust measurements of the cylinders.

In the example of FIG. 10B, control modes are switched based on the result of comparing a hydraulic pump discharge pressure measurement with a discharge pressure threshold. For example, when the hydraulic pump discharge pressure measurement is greater than the discharge pressure threshold, the control mode switcher 303 switches from the velocity control mode to the thrust control mode. The hydraulic pump discharge pressure measurement can be measured by providing a pressure sensor in the hydraulic circuit at the output side of the hydraulic pump 26 (FIG. 2).

When a shovel performs an excavation operation in excavation work, the hydraulic pump discharge pressure increases to generate large cylinder thrust. The discharge pressure threshold used to determine whether a load is being applied to an excavation object can be determined by actually performing excavation work and recording the temporal changes in the hydraulic pump discharge pressure.

In the example of FIG. 10C, control modes are switched based on the result of comparing a hydraulic pump discharge pressure measurement with a discharge pressure threshold and on a calculated bucket position. It is empirically known that while the bucket 17 is applying a load to an excavation object during excavation work, the position of the bucket 17 (the relative position with respect to the upper rotating body 12) falls within a particular region.

Figure 11:
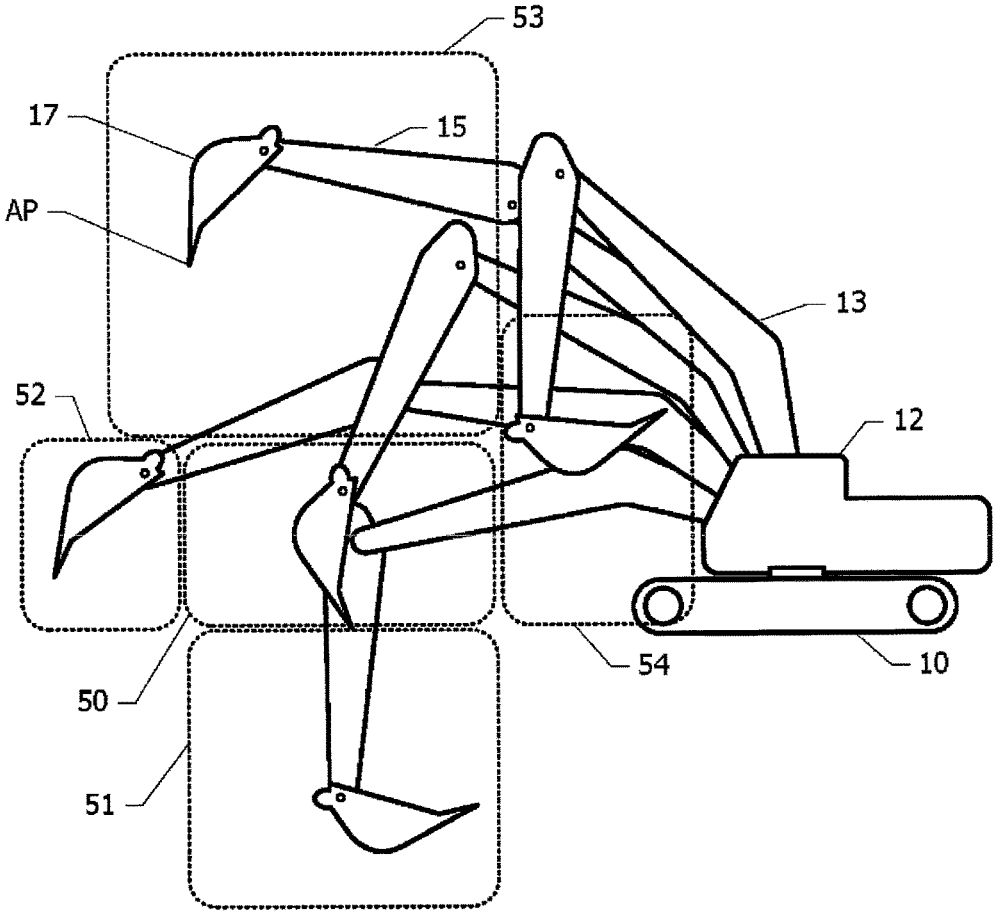
FIG. 11 is a drawing illustrating a moving range of a bucket during excavation.

The position of the bucket 17 during excavation work is described with reference to FIG. 11. The moving range of the point of application AP at the tip of the bucket 17 can be divided into an excavation region 50, a deep excavation region 51, a front-end region 52, a high region 53, and a near region 54. When the boom 13 and the arm 15 are extended forward, the point of application AP is positioned in the front-end region 52. When the bucket 17 is raised to a high position, the point of application AP is positioned in the high region 53. When the bucket 17 is pulled toward the upper rotating body 12, the point of application AP is positioned in the near region 54. When the point of application AP of the bucket 17 is in any one of the front-end region 52, the high region 53, and the near region 54, an operation to apply a load to an excavation object is generally not performed.

The excavation region 50 is defined at a position between the front-end region 52 and the near region 54 and below the high region 53. Also, the deep excavation region 51 is defined at a position deeper than the ground surface on which the lower traveling body 10 is located. When the point of application AP of the bucket 17 is in one of the excavation region 50 and the deep excavation region 51, it is likely that an operation to apply a load to an excavation object is performed.

In the example of FIG. 10C, in addition to the hydraulic pump discharge pressure measurement, the calculated bucket position is used as a criterion to switch the control modes. For example, while the calculated position of the bucket 17 is in one of the front-end region 52, the high region 53, and the near region 54, the control mode switcher 303 may be configured to not switch to the thrust control mode and maintain the velocity control mode even when the hydraulic discharge pressure measurement exceeds the discharge pressure threshold. Thus, by taking into account the position of the bucket 17 in determining whether to switch the control modes, it is possible to perform an operation that more accurately matches the demand of the operator.

In the embodiment of FIGS. 8 and 9 and the embodiments of FIGS. 10A through 10C, the reaction force applied to the bucket 17, the cylinder thrust, the hydraulic pump discharge pressure, and the position of the bucket 17 are used to determine whether to switch the control modes. However, other types of data related to operations of a shovel may also be used to determine whether to switch the control modes. In general, the thrust control mode may be used during excavation work, and the velocity control mode may be used in other occasions, i.e., while the bucket 17 is held in the air.

The embodiments of FIGS. 8, 9, and 10A through 10C make it possible to operate a shovel in a control mode that is optimal for the operating condition of the shovel.

An aspect of this disclosure provides a construction machine that can perform an appropriate control process in response to an operation performed by an operator to prevent reduction in work efficiency.

According to an embodiment, a hydraulic circuit is controlled based on a difference between a required thrust value and a thrust measurement to make the thrust of a hydraulic cylinder close to the required thrust value. This configuration makes it possible to prevent reduction in work efficiency even in work where a large reaction force is applied to a point of application.

Embodiments of the present invention are described above. However, the present invention is not limited to the specifically disclosed embodiments, and variations and modifications may be made without departing from the scope of the present invention.

What is claimed is:

1. A construction machine, comprising:

a hydraulic cylinder configured to drive an attachment;

a hydraulic circuit configured to supply hydraulic oil to the hydraulic cylinder;

an input device that is operated by an operator;

a controller configured to control the hydraulic circuit in at least one of a first control mode where the attachment is caused to generate a force corresponding to an operation amount of the input device and a second control mode where the attachment is driven at a velocity corresponding to the operation amount of the input device; and an attitude sensor that detects an attitude of the attachment, wherein the controller selects one of the first control mode and the second control mode based on the attitude of the attachment detected by the attitude sensor.

2. The construction machine as claimed in claim 1, wherein the controller is configured to switch between the first control mode and the second control mode.

3. The construction machine as claimed in claim 1, wherein the controller is configured to control the hydraulic circuit in the first control mode during an excavation operation.

4. The construction machine as claimed in claim 1, wherein the hydraulic circuit includes a hydraulic pump that discharges the hydraulic oil; and the controller is configured to select one of the first control mode and the second control mode based also on a measurement of a discharge pressure of the hydraulic pump.

5. The construction machine as claimed in claim 4, wherein the controller is configured to select one of the first control mode and the second control mode based also on a position of a tip of the attachment.

6. The construction machine as claimed in claim 1, further comprising:

a pressure sensor configured to measure a pressure of the hydraulic oil supplied to the hydraulic cylinder, wherein in the first control mode, the controller is configured to control the hydraulic circuit such that a thrust of the hydraulic cylinder obtained based on the pressure measured by the pressure sensor becomes close to a required thrust value calculated based on the operation amount of the input device.

7. The construction machine as claimed in claim 1, further comprising:

a flow rate sensor configured to measure a flow rate of the hydraulic oil flowing into the hydraulic cylinder, wherein in the second control mode, the controller is configured to control the hydraulic circuit such that a velocity of the hydraulic cylinder obtained based on the flow rate measured by the flow rate sensor becomes close to a required velocity value calculated based on the operation amount of the input device.

8. A construction machine, comprising:

a hydraulic cylinder configured to drive an attachment;

a hydraulic circuit configured to supply hydraulic oil to the hydraulic cylinder;

an input device that is operated by an operator; and a controller configured to control the hydraulic circuit in at least one of a first control mode where the attachment is caused to generate a force corresponding to an operation amount of the input device and a second control mode where the attachment is driven at a velocity corresponding to the operation amount of the input device, wherein the attachment includes a boom, an arm, and a bucket; and the controller is configured to select the second control mode and control the hydraulic circuit in the selected second control mode while the bucket is held in the air and no reaction force is being applied to the bucket.

9. A construction machine, comprising:

a hydraulic cylinder configured to drive an attachment;

a hydraulic circuit configured to supply hydraulic oil to the hydraulic cylinder;

an input device that is operated by an operator; and a controller configured to control the hydraulic circuit in at least one of a first control mode where the attachment is caused to generate a force corresponding to an operation amount of the input device and a second control mode where the attachment is driven at a velocity corresponding to the operation amount of the input device, wherein the controller is configured to select one of the first control mode and the second control mode based on a pressure of the hydraulic oil supplied to the hydraulic cylinder.

* * * * *